US005484469A

United States Patent [19]

Rutz et al.

[11] Patent Number: 5,484,469

[45] Date of Patent: Jan. 16, 1996

[54] METHOD OF MAKING A SINTERED METAL COMPONENT AND METAL POWDER COMPOSITIONS THEREFOR

[75] Inventors: Howard G. Rutz, Newtown; Sidney Luk, Lafayette Hill, both of Pa.

[73] Assignee: Hoeganaes Corporation, Riverton, N.J.

[21] Appl. No.: 372,138

[22] Filed: Jan. 13, 1995

Related U.S. Application Data

[60] Continuation of Ser. No. 917,869, Jul. 21, 1992, abandoned, which is a division of Ser. No. 835,808, Feb. 14, 1992, Pat. No. 5,154,881.

[51] Int. Cl.[6] ..... B22F 1/00; B22F 5/00

[52] U.S. Cl. ..... 75/252; 75/255

[58] Field of Search ..... 75/255, 252

[56] References Cited

U.S. PATENT DOCUMENTS

| | | | |
|---|---|---|---|
| 3,410,684 | 11/1968 | Printz | 75/214 |
| 3,784,577 | 1/1974 | Fukumaru et al. | 260/404 |
| 3,995,059 | 11/1976 | Fukumaru et al. | 424/324 |
| 4,002,474 | 1/1977 | Blachford | 264/111 |
| 4,106,932 | 8/1978 | Blachford | 75/252 |
| 4,721,599 | 1/1988 | Nakamura | 419/23 |
| 4,765,950 | 8/1988 | Johnson | 419/2 |
| 4,955,798 | 9/1990 | Musella et al. | 419/31 |
| 4,964,907 | 10/1990 | Kiyota et al. | 75/235 |
| 5,043,118 | 8/1991 | Kim et al. | 264/63 |
| 5,055,198 | 10/1991 | Kiyota et al. | 75/246 |
| 5,080,846 | 1/1992 | Kim et al. | 264/109 |
| 5,098,648 | 2/1992 | Kioyta et al. | 419/23 |
| 5,108,492 | 4/1992 | Kiyota et al. | 75/246 |
| 5,143,692 | 9/1992 | Van der Zel | 419/8 |

FOREIGN PATENT DOCUMENTS

| | | |
|---|---|---|
| 0329475 | 8/1989 | European Pat. Off. . |
| 2258263 | 8/1975 | France . |
| 2305774 | 8/1974 | Germany . |
| 53-24948 | 3/1978 | Japan . |
| 62-260806 | 10/1987 | Japan . |
| 64-292883 | 11/1989 | Japan . |
| 1165240 | 9/1969 | United Kingdom . |

OTHER PUBLICATIONS

Promold™; "Performance Data"; 1991 Morton International, Inc.

A. W. Ralston, "Fatty Acids and Their Derivatives," John Wiley & Sons, Inc., New York, p. 1.

Humko Chemical Product Guide, "Opportunities with Humko Chemical Kemamide Fatty Amides".

W. D. Jones, "Fundamental Principles of Powder Metallurgy," 1960, pp. 350–367.

*Primary Examiner*—Ngoclan Mai
*Assistant Examiner*—Daniel J. Jenkins
*Attorney, Agent, or Firm*—Woodcock Washburn Kurtz Mackiewicz & Norris

[57] ABSTRACT

Methods of making sintered parts from a metal powder composition that contains an amide lubricant are provided. The composition comprises an iron-based powder and a lubricant that is the reaction product of a monocarboxylic acid, a dicarboxylic acid, and a diamine. The composition is compacted in a die, preferably at an elevated temperature of up to about 370° C., at conventional compaction pressures, and then sintered according to standard powder-metallurgical techniques.

21 Claims, No Drawings

METHOD OF MAKING A SINTERED METAL COMPONENT AND METAL POWDER COMPOSITIONS THEREFOR

This is a continuation of application Ser. No. 07/917,869 filed Jul. 21, 1992, abandoned, which is a divisional application of Ser. No. 07/835,808, filed Feb. 14, 1992, now U.S. Pat. No. 5,154,881.

FIELD OF THE INVENTION

The present invention relates to methods of compacting lubricated metal powder compositions at elevated temperatures to make sintered components. The invention further relates to the compositions of iron-based metal powders admixed with an amide lubricant suitable for elevated compaction temperatures.

BACKGROUND OF THE INVENTION

The powder metallurgy art generally uses four standard temperature regimes for the compaction of a metal powder to form a metal component. These include chill-pressing (pressing below ambient temperatures), cold-pressing (pressing at ambient temperatures), hot-pressing (pressing at temperatures above those at which the metal powder is capable of retaining work-hardening), and warm-pressing (pressing at temperatures between cold-pressing and hot-pressing).

Distinct advantages arise by pressing at temperatures above ambient temperature. The tensile strength and work hardening rate of most metals is reduced with increasing temperatures, and improved density and strength can be attained at lower compaction pressures. The extremely elevated temperatures of hot-pressing, however, introduce processing problems and accelerate wear of the dies. Therefore, current efforts are being directed towards the development of warm-pressing processes and metal compositions suitable for such processes.

Warm-pressing also has the problem of wear of the die walls caused by ejecting the compacted part from the die. Various lubricants are currently employed, as in U.S. Pat. No. 4,955,798 to Musella et al., that allow pressing to be accomplished with lubricants having melting points up to 150° C. (300° F.). Pressing above this temperature with these known lubricants, however, results in degradation of the lubricant and leads to die scoring and wear.

Therefore, a need exists to formulate lubricated metal powder compositions capable of withstanding increased pressing temperatures. Such metal powder compositions would exhibit improved densities and other strength properties. Such powder compositions and pressing methods would enable among other benefits, increased densities at lower pressing pressures, lower ejection forces required to remove the compacted component, and reduced die wear.

SUMMARY OF THE INVENTION

The present invention provides methods for making sintered parts from a metal powder composition that contains an amide lubricant. The present invention also provides novel metal powder compositions that contain an iron-based powder and the amide lubricant, which is the reaction product of a monocarboxylic acid, a dicarboxylic acid, and a diamine. This composition is compacted in a die at a temperature up to about 370° C., preferably in the range of about 150°–260° C., at conventional pressures, and the compacted composition is then sintered by conventional means.

The method and the composition are useful with any iron-based powder composition. By "iron-based powder" is meant any of the iron-containing particles generally used in the practice of powder metallurgy including, but not limited to, particles of substantially pure iron; particles of iron in admixture with, for example, particles of alloying elements such as transition metals and/or other fortifying elements; and particles of pre-alloyed iron.

The amount of lubricant to be used can be up to about 15 weight percent of the composition, based on the total weight of metal powder and lubricant. A preferred embodiment contains from about 0.1 to about 10 weight percent lubricant. Because the lubricants of this invention are reaction-product mixtures, they melt over a temperature range that can encompass 250 degrees centigrade. Depending on the particular lubricant used, melting will commence at a temperature between about 150° C. (300° F.) and 260° C. (500° F.), and the lubricant mixture will be completely melted at some temperature up to 250 degrees centigrade above this initial melting point.

DETAILED DESCRIPTION OF THE INVENTION

A method for making a sintered metal part having improved mechanical properties is herein set forth. The present method employs an amide lubricant that is admixed with iron-based metal powders prior to compaction. The presence of the lubricant permits compaction of the powder composition at higher temperatures without significant die wear. The compacted composition displays improved "green" (presintering) properties such as strength and density. The compacted composition can be sintered by conventional means.

The metal powder compositions that are the subject of the present invention contain iron-based particles of the kind generally used in powder metallurgical methods. Examples of "iron-based" particles, as that term is used herein, are particles of substantially pure iron; particles of iron pre-alloyed with other elements (for example, steel-producing elements) that enhance the strength, hardenability, electromagnetic properties, or other desirable properties of the final product; and particles of iron in admixture with particles of such alloying elements.

Substantially pure iron powders that can be used in the invention are powders of iron containing not more than about 1.0% by weight, preferably no more than about 0.5% by weight, of normal impurities. Examples of such highly compressible, metallurgical-grade iron powders are the Ancorsteel® 1000 series of pure iron powders available from Hoeganaes Corporation, Riverton, N.J.

The iron-based powder can incorporate one or more alloying elements that enhance the mechanical or other properties of the final metal part. Such iron-based powders can be in the form of an admixture of powders of pure iron and powders of the alloying elements or, in a preferred embodiment, can be powders of iron that has been pre-alloyed with one or more such elements. The admixture of iron powder and alloying-element powder is prepared using known mechanical mixing techniques. The pre-alloyed powders can be prepared by making a melt of iron and the desired alloying elements, and then atomizing the melt, whereby the atomized droplets form the powder upon solidification.

Examples of alloying elements that can be incorporated into the iron-based powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its Ancorsteel® line of powders. Premixes of pure iron powders with alloying-element powders are also available from Hoeganaes Corp. as Ancorbond® powders.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes Ancorsteel® 85HP steel powder, which contains 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeganaes Ancorsteel® 4600V steel powder, which contains about 0.5–0.6 weight percent molybdenum, about 1.5– 2.0 weight percent nickel, and about 0.1–0.25 weight percent manganese, and less than about 0.02 weight percent carbon.

Another pre-alloyed iron-based powder that can be used in the invention is disclosed in allowed U.S. Ser. No. 07/695,209, filed May 3, 1991, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition.

Other iron-based powders that are useful in the practice of the invention are ferromagnetic powders, such as particles of iron pre-alloyed with small amounts of phosphorus. Other good ferromagnetic materials are mixtures of ferrophosphorus powders, such as iron-phosphorus alloys or iron phosphide compounds in powdered form, with particles of substantially pure iron. Such powder mixtures are disclosed in U.S. Pat. No. 3,836,355 issued September 1974 to Tengzelius et al. and U.S. Pat. No. 4,093,449 issued June 1978 to Svensson et al.

The particles of iron or pre-alloyed iron can have a weight average particle size as small as one micron or below, or up to about 850–1,000 microns, but generally the particles will have a weight average particle size in the range of about 10–500 microns. Preferred are iron or pre-alloyed iron particles having a maximum average particle size up to about 350 microns. With respect to those iron-based powders that are admixtures of iron particles with particles of alloying elements, it will be recognized that particles of the alloying elements themselves are generally of finer size than the particles of iron with which they are admixed. The alloying-element particles generally have a weight average particle size below about 100 microns, preferably below about 75 microns, and more preferably in the range of about 5–20 microns.

The metal powder compositions that are the subject of the present invention also contain an amide lubricant that is, in essence, a high melting-point wax. The lubricant is the condensation product of a dicarboxylic acid, a monocarboxylic acid, and a diamine.

The dicarboxylic acid is a linear acid having the general formula HOOC(R)COOH where R is a saturated or unsaturated linear aliphatic chain of 4–10, preferably about 6–8, carbon atoms. Preferably, the dicarboxylic acid is a $C_8$–$C_{10}$ saturated acid. Sebacic acid is a preferred dicarboxylic acid. The dicarboxylic acid is present in an amount of from about 10 to about 30 weight percent of the starting reactant materials.

The monocarboxylic acid is a saturated or unsaturated $C_{10}$–$C_{22}$ fatty acid. Preferably, the monocarboxylic acid is a $C_{12}$–$C_{20}$ saturated acid. Stearic acid is a preferred saturated monocarboxylic acid. A preferred unsaturated monocarboxylic acid is oleic acid. The monocarboxylic acid is present in an amount of from about 10 to about 30 weight percent of the starting reactant materials.

The diamine is an alkylene diamine, preferably of the general formula $(CH_2)_x(NH_2)_2$ where x is an integer of about 2–6. Ethylene diamine is the preferred diamine. The diamine is present in an amount of from about 40 to about 80 weight percent of the starting reactant materials to form the amide product.

The condensation reaction is preferably conducted at a temperature of from about 260°–280° C. and at a pressure up to about 7 atmospheres. The reaction is preferably conducted in a liquid state. Under reaction conditions at which the diamine is in a liquid state, the reaction can be performed in an excess of the diamine acting as a reactive solvent. When the reaction is conducted at the preferred elevated temperatures as described above, even the higher molecular weight diamines will generally be in liquid state. A solvent such as toluene, or p-xylene can be incorporated into the reaction mixture, but the solvent must be removed after the reaction is completed, which can be accomplished by distillation or simple vacuum removal. The reaction is preferably conducted under an inert atmosphere such as nitrogen and in the presence of a catalyst such as 0.1 weight percent methyl acetate and 0.001 weight percent zinc powder. The reaction is allowed to proceed to completion, usually not longer than about 6 hours.

The lubricants formed by the condensation reaction are a mixture of amides characterized as having a melting range rather than a melting point. As those skilled in the art will recognize, the reaction product is generally a mixture of moieties whose molecular weights, and therefore properties dependent on such, will vary. The reaction product can generally be characterized as a mixture of diamides, monoamides, bisamides, and polyamides. The preferred amide product has at least about 50%, more preferably at least about 65%, and most preferably at least about 75%, by weight diamide compounds. The preferred amide product mixture contains primarily saturated diamides having from 6 to 10 carbon atoms and a corresponding weight average molecular weight range of from 144 to 200. A preferred diamide product is N,N'-bis{2-[ (1-oxooctadecyl)amino] ethyl} diamide.

The reaction product, containing a mixture of amide moieties, is well suited as a warm-pressing metallurgical lubricant. The presence of monoamides allows the lubricant to act as a liquid lubricant at the pressing conditions, while the diamide and higher melting species act as both liquid and solid lubricants at these conditions.

As a whole, the amide lubricant begins to melt at a temperature between about 150° C. (300° F.) and 260° C. (500° F.), preferably about 200° C. (400° F.) to about 260° C. (500° F.). The amide product will generally be fully melted at a temperature about 250 degrees centigrade above this initial melting temperature, although it is preferred that the amide reaction product melt over a range of no more than about 100 degrees centigrade.

The preferred amide product mixture has an acid value of from about 2.5 to about 5; a total amine value of from about 5 to 15, a density of about 1.02 at 25° C., a flash point of about 285° C. (545° F.), and is insoluble in water.

A preferred lubricant is commercially available as ADVAWAX® 450 amide sold by Morton International of Cincinnati, Ohio, which is an ethylene bis-stearamide having an initial melting point between about 200° C. and 300° C.

The amide lubricant will generally be added to the composition in the form of solid particles. The particle size of the lubricant can vary, but is preferably below about 100 microns. Most preferably the lubricant particles have a weight average particle size of about 5–50 microns. The lubricant is admixed with the iron-based powder in an amount up to about 15% by weight of the total composition. Preferably the amount of lubricant is from about 0.1 to about 10 weight percent, more preferably about 0.1–1.0 weight percent, and most preferably about 0.2–0.8 weight percent, of the composition. The iron-based metal particles and lubricant particles are admixed together, preferably in dry form, by conventional mixing techniques to form a substantially homogeneous particle blend.

The metal powder composition containing the iron-based metal powders and particles of amide lubricant, as above described, is compacted in a die, preferably at "warm" temperatures as understood in the metallurgy arts, and the compacted "green" part is thereafter removed from the die and sintered, also according to standard metallurgical techniques. The metal powder composition is compressed at a compaction temperature—measured as the temperature of the composition as it is being compacted—up to about 370° C. (700° F.). Preferably the compaction is conducted at a temperature above 100° C. (212° F.), more preferably at a temperature of from about 150° C. (300° F.) to about 260° C. (500° F.). Typical compaction pressures are about 5–200 tons per square inch (69–2760 MPa), preferably about 20–100 tsi (276–1379 MPa), and more preferably about 25–60 tsi (345–828 MPa). The presence of the lubricant in the metal powder composition enables this warm compaction of the composition to be conducted practically and economically. The lubricant reduces the stripping and sliding pressures generated at the die wall during ejection of the compacted component from the die, reducing scoring of the die wall and prolonging the life of the die. Following compaction, the part is sintered, according to standard metallurgical techniques, at temperatures and other conditions appropriate to the composition of the iron-based powder.

The improved characteristics of compacted components formed with use of the lubricant at the elevated compaction temperatures are indicated by their increased green and sintered densities, transverse rupture strength, and hardness ($R_B$). Sample bars were prepared by compacting the metal powder composition at various temperatures and pressures. The bars were about 1.25 inches in length, about 0.5 inches in width, and about 0.25 inches in height.

The green density and green strength of compacted bars are listed in Table 1 for components made from a mixture of approximately 99% by weight of Hoeganaes Corp. Ancorsteel® 4600V (iron-based powder composition having 0.01% wt. C., 0.54% wt. Mo, 1.84% wt. Ni, 0.17% wt. Mn, 0.16% wt. oxygen; with a particle size range of 11% wt. +100 mesh and 21% wt. - 325 mesh), 0.5% by weight graphite, and 0.5% by weight ADVAWAX® 450 amide.

TABLE 1

Green Density (g/cc) and Green Strength (psi) of Warm Pressed Mixtures of 99% Ancorsteel ® 4600 V, 0.5% Graphite, 0.5% ADVAWAX ® 450

| Compaction Temperature (°F.) | Compaction Pressure (tsi) 30 Green Density | 30 Green Strength | 40 Green Density | 40 Green Strength | 50 Green Density | 50 Green Strength |
|---|---|---|---|---|---|---|
| Ambient | 6.71 | 1430 | 6.90 | 1790 | 7.06 | 2100 |
| 200 | 6.74 | 1810 | 7.00 | 2350 | 7.19 | 2900 |
| 300 | 6.79 | 2400 | 7.03 | 3100 | 7.25 | 3850 |
| 400 | 6.84 | 3520 | 7.08 | 4400 | 7.25 | 5070 |
| 475 | 6.87 | 4320 | 7.15 | 5440 | 7.31 | 6090 |

Table II lists the results of the same admixture (99% Ancorsteel® 4600V, 0.5% graphite, 0.5% ADVAWAX® 450) pressed at several compaction pressures and temperatures, followed by sintering at 2050° F. in a dissociated ammonia atmosphere (75% $H_2$, 25% N) for 30 minutes at temperature. Transverse rupture strength was determined according to the Standard 41 of "Material Standards for PM Structured Parts", published by Metal Powder Industries Federation (1990–91 Edition).

TABLE II

Sintered Properties of Warm Pressed Mixtures of 99% ANCORSTEEL ® 4600 V, 0.5% ADVAWAX ® 450, 0.5% Graphite

| Compacting Temperature | Compacting Pressure (tsi) | Sintered Density (g/cc) | Transverse Rupture Strength (psi) | Hardness $R_5$ |
|---|---|---|---|---|
| Ambient | 25 | 6.36 | 78,900 | 49 |
| | 30 | 6.64 | 96,690 | 61 |
| | 35 | 6.83 | 111,670 | 67 |
| | 40 | 6.95 | 122,749 | 72 |
| | 45 | 7.03 | 135,802 | 75 |
| | 50 | 7.10 | 139,233 | 77 |
| | 55 | 7.17 | 149,492 | 79 |
| 200° F. | 25 | 6.55 | 94,647 | 56 |
| | 30 | 6.79 | 112,044 | 65 |
| | 35 | 6.95 | 126,339 | 72 |
| | 40 | 7.04 | 135,394 | 75 |
| | 45 | 7.12 | 148,230 | 79 |
| | 50 | 7.21 | 155,297 | 81 |
| | 55 | 7.27 | 161,581 | 82 |
| 300° F. | 25 | 6.60 | 98,064 | 58 |
| | 30 | 6.78 | 115,698 | 65 |
| | 35 | 6.96 | 134,287 | 71 |
| | 40 | 7.07 | 146,293 | 75 |

TABLE II-continued

Sintered Properties of Warm Pressed Mixtures of 99% ANCORSTEEL ® 4600 V, 0.5% ADVAWAX ® 450, 0.5% Graphite

| Compacting Temperature | Compacting Pressure (tsi) | Sintered Density (g/cc) | Transverse Rupture Strength (psi) | Hardness $R_5$ |
|---|---|---|---|---|
| | 45 | 7.23 | 162,314 | 81 |
| | 50 | 7.26 | 164,591 | 82 |
| | 55 | 7.32 | 170,721 | 84 |
| 400° F. | 25 | 6.63 | 103,920 | 61 |
| | 30 | 6.83 | 122,536 | 67 |
| | 35 | 6.99 | 138,180 | 74 |
| | 40 | 7.13 | 157,300 | 79 |
| | 45 | 7.23 | 168,528 | 82 |
| | 50 | 7.29 | 176,065 | 84 |
| | 55 | 7.31 | 175,690 | 85 |
| 475° F. | 25 | 6.59 | 98,597 | 58 |
| | 30 | 6.92 | 130,274 | 71 |
| | 35 | 7.05 | 148,318 | 75 |
| | 40 | 7.27 | 159,208 | 80 |
| | 45 | 7.27 | 171,762 | 82 |
| | 50 | 7.37 | 182,494 | 85 |
| | 55 | 7.37 | 182,494 | 84 |

Table III indicates the results of similar testing performed on an admixture of essentially 93.05% by weight of iron prealloyed with 0.85% by weight of molybdenum (Ancorsteel® 85HP powder available from Hoeganaes Corp.), 4% by weight of nickel powder (grade 123 from Into Corporation), 2% by weight −100 mesh copper powder, 0.45% by weight graphite, and 0.5% by weight ADVAWAX® 450. Following compaction at several pressures and temperatures, the test pieces were sintered in dissociated ammonia at 2050° F. for 30 minutes at temperature.

TABLE III

Sintered Properties of Warm Pressed Mixtures of 93.05% ANCORSTEEL ® 85 HP Iron-Based Powder with 4% Nickel, 2% Copper, 0.45% Graphite and 0.5% ADVAWAX ® 450

| Compacting Temperature | Compacting Pressure (tsi) | Sintered Density (g/cc) | Transverse Rupture Strength (psi) | Hardness $R_5$ |
|---|---|---|---|---|
| Ambient | 25 | 6.62 | 158,400 | 87 |
| | 30 | 6.78 | 176,810 | 90 |
| | 35 | 6.90 | 185,930 | 94 |
| | 40 | 6.97 | 195,390 | 95 |
| | 45 | 7.03 | 196,509 | 96 |
| | 50 | 7.10 | 199,080 | 97 |
| | 55 | 7.13 | 199,031 | 97 |
| 200° F. | 25 | 6.70 | 172,510 | 90 |
| | 30 | 6.88 | 189,550 | 94 |
| | 35 | 6.99 | 206,250 | 96 |
| | 40 | 7.09 | 220,210 | 97 |
| | 45 | 7.15 | 221,270 | 99 |
| | 50 | 7.17 | 228,990 | 99 |
| | 55 | 7.20 | 230,000 | 100 |
| 300° F. | 25 | 6.81 | 183,350 | 91 |
| | 30 | 6.96 | 203,500 | 96 |
| | 35 | 7.13 | 228,140 | 97 |
| | 40 | 7.20 | 243,270 | 99 |
| | 45 | 7.26 | 230,560 | 99 |
| | 50 | 7.29 | 242,500 | 101 |
| | 55 | 7.30 | 243,990 | 101 |
| 400° F. | 25 | 6.82 | 186,930 | 93 |
| | 30 | 7.06 | 222,660 | 97 |
| | 35 | 7.16 | 240,100 | 99 |

TABLE III-continued

Sintered Properties of Warm Pressed Mixtures of 93.05% ANCORSTEEL ® 85 HP Iron-Based Powder with 4% Nickel, 2% Copper, 0.45% Graphite and 0.5% ADVAWAX ® 450

| Compacting Temperature | Compacting Pressure (tsi) | Sintered Density (g/cc) | Transverse Rupture Strength (psi) | Hardness $R_5$ |
|---|---|---|---|---|
| | 40 | 7.25 | 259,690 | 101 |
| | 45 | 7.31 | 266,100 | 101 |
| | 50 | 7.30 | 252,240 | 101 |
| | 55 | 7.31 | 266,640 | 102 |
| 475° F. | 25 | 6.89 | 196,740 | 94 |
| | 30 | 7.14 | 236,800 | 98 |
| | 35 | 7.22 | 243,320 | 100 |
| | 40 | 7.27 | 255,360 | 100 |
| | 45 | 7.32 | 246,150 | 100 |
| | 50 | 7.33 | 248,270 | 101 |
| | 55 | 7.31 | 246,660 | 102 |

Table IV lists green and sintered densities for an admixture of approximately 96.35% by weight iron powder (Ancorsteel® 1000, A1000, available from Hoeganaes Corp.), 2% by weight −100 mesh copper powder, 0.9% by weight graphite, 0.75% by weight of ADVAWAX® 450. Following compaction at various temperatures and pressures, these test pieces were sintered at 2050° F. in dissociated ammonia for 30 minutes at temperature.

TABLE IV

Green and Sintered Densities (g/cc) of Warm Pressed Admixtures (96.35% A1000, 2% Cu, 0.9% Graphite and 0.75% ADVAWAX ® 450)

| Compaction Temperature (°F.) | Compaction Pressure (tsi) 30 Green Density | 30 Sintered Density | 40 Green Density | 40 Sintered Density | 50 Green Density | 50 Sintered Density |
|---|---|---|---|---|---|---|
| Ambient | 6.73 | 6.65 | 6.83 | 6.73 | 7.06 | 7.00 |
| 200 | 6.89 | 6.80 | 7.08 | 6.99 | 7.15 | 7.07 |
| 300 | 7.01 | 6.91 | 7.16 | 7.08 | 7.18 | 7.13 |
| 400 | 7.01 | 6.92 | 7.13 | 7.09 | 7.14 | 7.11 |

Ejection forces can be characterized by the peak pressure needed to start moving the compacted piece from the die. The ejection of the part from the die is made by removing one of the two punches from the die and punch assembly and then by pushing the die past the stationary second punch ejecting the part. This die movement causes a force on the part that is also transmitted to the stationary punch. A load cell can be placed on the punch and the resulting peak load (in pounds) can be recorded. This load can be converted into a pressure by dividing the load by the area of the part in contact with the die (pressure=load/[2×height×(length+width)] for a rectangular bar). This pressure is recorded as the peak ejection pressure. Measurements were made on the previous admixture (Ancorsteel® 1000+2% Cu+0.9% graphite+0.75% ADVAWAX® 450) at various pressures and temperatures, and are listed in Table V. The ejection forces are well within acceptable levels for manufacturing powder metallurgy parts.

TABLE V

Peak Ejection Forces (tsi) of Warm Pressed Admixture (A1000 + 2% Cu + 0.9% Graphite + 0.75% ADVAWAX ® 450)

| Compaction Temperature (°F.) | Compaction Pressures (tsi) 30 Peak Ejection Pressure (tsi) | 40 Peak Ejection Pressure (tsi) | 50 Peak Ejection Pressure (tsi) |
|---|---|---|---|
| Ambient | 2.49 | 3.15 | 3.34 |
| 200 | 2.03 | 2.07 | 2.16 |
| 300 | 1.81 | 2.01 | 2.12 |
| 400 | 2.05 | 2.25 | 2.14 |

What is claimed is:

1. An iron-based powder composition comprising:

(a) an iron-based powder; and (b) an amide lubricant, in an amount up to about 15% by weight of said composition, that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

2. The composition of claim 1 wherein the monocarboxylic acid is stearic acid.

3. The composition of claim 1 wherein the dicarboxylic acid is sebacic acid.

4. The composition of claim 1 wherein the diamine is ethylene diamine.

5. The composition of claim 1 wherein the monocarboxylic acid is stearic acid, the dicarboxylic acid is sebacic acid and the diamine is ethylene diamine; and wherein the amide lubricant has a melting range that begins at a temperature of at least about 150° C.

6. The powder composition of claim 5 wherein the lubricant is present in an amount of from about 0.1 to about 1 weight percent.

7. The powder composition of claim 5 wherein said iron-based powder comprises iron that has been pre-alloyed with at least one alloying element selected from the group consisting of molybdenum, manganese, magnesium, chromium, silicon, copper, nickel, gold, chromium, vanadium, columbium, carbon, graphite, phosphorus, and aluminum.

8. The powder composition of claim 1 wherein diamides constitute at least about 65 percent by weight of said reaction product.

9. An iron-based powder composition comprising:

(a) an iron-based powder; and (b) an amide lubricant, in an amount of from about 0.1 to about 15% by weight of said composition, that is the reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

10. The composition of claim 9 wherein the monocarboxylic acid comprises stearic acid or oleic acid.

11. The composition of claim 9 wherein the dicarboxylic acid comprises sebacic acid.

12. The composition of claim 9 wherein the diamine comprises ethylene diamine.

13. The composition of claim 9 wherein the amide lubricant is present in an amount of from about 0.1 to about 10 weight percent of the composition.

14. The composition of claim 9 wherein the amide lubricant is present in an amount of from about 0.1–1.0 weight percent of the composition.

15. The composition of claim 14 wherein the amide lubricant comprises diamides constituting at least about 65 percent by weight of said reaction product.

16. The composition of claim 15 wherein the weight average particle size of the amide lubricant is from 5–50 microns.

17. The composition of claim 14 wherein the iron-based powder comprises an admixture of a substantially pure iron powder and at least one alloying element powder, wherein the iron-based powder has a weight average particle size in the range of about 10–500 microns and wherein the alloying element powder has a weight average particle size of below about 75 microns.

18. The composition of claim 14 wherein the iron-based powder comprises a pre-alloyed powder comprising iron and at least one alloying element wherein the iron-based powder has a weight average particle size in the range of about 10–500 microns.

19. An iron-based powder composition consisting essentially of:

(a) an iron-based powder; and (b) an amide lubricant, in an amount of from about 0.1 to about 1.0% by weight of said composition, that is the reaction product of about 10–30 weight percent of a $C_6$–$C_{12}$ linear dicarboxylic acid comprising sebacic acid, about 10–30 weight percent of a $C_{10}$–$C_{22}$ monocarboxylic acid comprising stearic or oleic acid, and about 40–80 weight percent of a diamine having the formula $(CH_2)_x(NH_2)_2$ where x is 2–6 comprising ethylene diamine, wherein the reaction product is at least 65% wt. diamide and has a weight average particle size of from 5–50 microns.

20. The composition of claim 19 wherein the iron-based powder comprises an admixture of a substantially pure iron powder and at least one alloying element powder, wherein the iron-based powder has a weight average particle size in the range of about 10–500 microns and wherein the alloying element powder has a weight average particle size of below about 75 microns.

21. The composition of claim 19 wherein the iron-based powder comprises a pre-alloyed powder comprising iron and at least one alloying element wherein the iron-based powder has a weight average particle size in the range of about 10–500 microns.

* * * * *